United States Patent [19]

Rogers et al.

[11] Patent Number: 4,644,730

[45] Date of Patent: Feb. 24, 1987

[54] METHOD AND APPARATUS FOR FOLDING ARTICLES ON HEADER CARDS

[75] Inventors: William R. Rogers, Fremont; Duane B. Liescheidt, White Cloud, both of Mich.

[73] Assignee: Gerber Products Company, Fremont, Mich.

[21] Appl. No.: 790,926

[22] Filed: Oct. 24, 1985

[51] Int. Cl.[4] ..... B65B 11/00

[52] U.S. Cl. ..... 53/397; 53/156; 53/117; 53/429; 53/462; 53/580

[58] Field of Search ..... 53/117, 206, 207, 209, 53/374, 383, 429, 460, 462, 464, 156, 238, 397, 580

[56] References Cited

U.S. PATENT DOCUMENTS

| | | | |
|---|---|---|---|
| 1,830,889 | 11/1931 | Sague | 53/206 |
| 3,374,940 | 3/1968 | Allison | 53/460 |
| 3,716,962 | 2/1973 | Langen et al. | 53/209 |
| 4,037,386 | 7/1977 | Sjoman | 53/117 |
| 4,179,111 | 12/1979 | Gunther Jr. et al. | 53/206 |
| 4,215,522 | 8/1980 | Clift et al. | 53/378 |

*Primary Examiner*—John Sipos
*Assistant Examiner*—Donald R. Studebaker
*Attorney, Agent, or Firm*—Townsend and Townsend

[57] ABSTRACT

Header cards adapted for folding around small flexible articles, such as infants vinyl pants, are packaged on an automatic folding machine. The folding machine includes a first station for automatically feeding unfolded header cards from a magazine onto a conveyor. A second station provides for folding of a first flap onto the header card using an inclined bar and a plunger assembly. A third station provides for folding and sealing the two side flaps, while the fourth station holds the package together until the adhesive has had a chance to set.

17 Claims, 10 Drawing Figures

METHOD AND APPARATUS FOR FOLDING ARTICLES ON HEADER CARDS

BACKGROUND OF THE INVENTION

1. Field of the Invention

The present invention relates generally to methods and machines for folding articles, and more particularly to methods and machines for folding small flexible articles onto header cards.

A popular approach for packaging and displaying small merchandise items involves mounting the item on a support card, typically referred to as a header card. This approach is particularly useful for packaging small flexible items, such as small clothing articles, which may then be displayed on the rigid framework of the header card. In the simplest cases, the header card will be merely a rectangular piece of cardboard around which the article is wrapped. In other cases, the header card may include one or more flaps which may then be folded together with the article. Once the article is folded on or with the header card, the article may be wrapped in an outer cover to protect the exposed article, although this is not necessary in all cases. Many header careds require that the mounted article be held in place by stapling to the header card. While functional as a means for securing the article to the card, it is often undesirable to staple the article itself.

2. Description of the Background Art

U.S. Pat. No. 3,742,676 to Lawing et al. describes a method and apparatus for packaging hosiery about an insert board.

SUMMARY OF THE INVENTION

The present invention is a method and apparatus for packaging small fabric articles, typically vinyl pants for infants, on cardboard header cards. The header cards include a central portion having three flaps extending outward therefrom. The vinyl pants are placed on the central portion of the header card and a first flap, referred to as a divider flap, is folded over the pants. A second flap, referred to as the backflap, which projects orthogonally from the divider flap is then folded over the divider flap, usually folding a portion of the pants therewith. An adhesive is then applied to the exposed surface of the back flap, and the third flap which extends out from the central portion of the header card in the opposite direction from the second flap, is folded back over to seal against the second flap. Care is taken to assure that the pants are not folded between the second and third flaps to avoid interference with the seal. In this way, the vinyl pants are firmly mounted on the header card without the necessity of stapling the package. Moreover, the header card protects the vinyl pants while exposing a sufficient portion of the pants for the consumer to inspect prior to purchase.

The present invention also provides a novel apparatus adapted particularly to fold header cards of the type just described. The apparatus includes a conveyor means for incrementally advancing the header cards through at least four separate work stations. At the first work station, the unfolded header cards are placed on the conveyor means with the central portion on the conveyor and the divider flap extending transversely from one side of the conveyor, while the side flaps are located on the other side of the conveyor. As the header card is advanced to the second work station, an inclined bar raises the divider flap until it extends upward at approximately a right angle from the conveyor. The vinyl pants are then placed on the header card, typically manually, with the pants straddling both the central portion and the back flap. The divider flap is then folded downward by a plunger assembly. After advancing the header card to the next work station, folding arms are raised from beneath the header card to fold the back flap over the divider flap. Since the vinyl pants were initially placed over both the central portion and the backflap of the header card, the vinyl pants will also be folded over the divider flap. Glue is then applied to the exposed surface of the back flap, and the leading flap raised by a reciprocatable ramp which extends upward as the header card is further advanced on the conveyor. After being raised, the leading flap is folded back over onto the back flap by a fixed bar mounted transversely over the conveyor. The leading flap is held against the back flap for a sufficient time to allow the glue to set by a pressure plate which is mounted over the conveyor downstream from the third work station. In this way, the article is in its finished package state which it is discharged from the folding apparatus.

DESCRIPTION OF THE PREFERRED EMBODIMENTS

Figure 1:
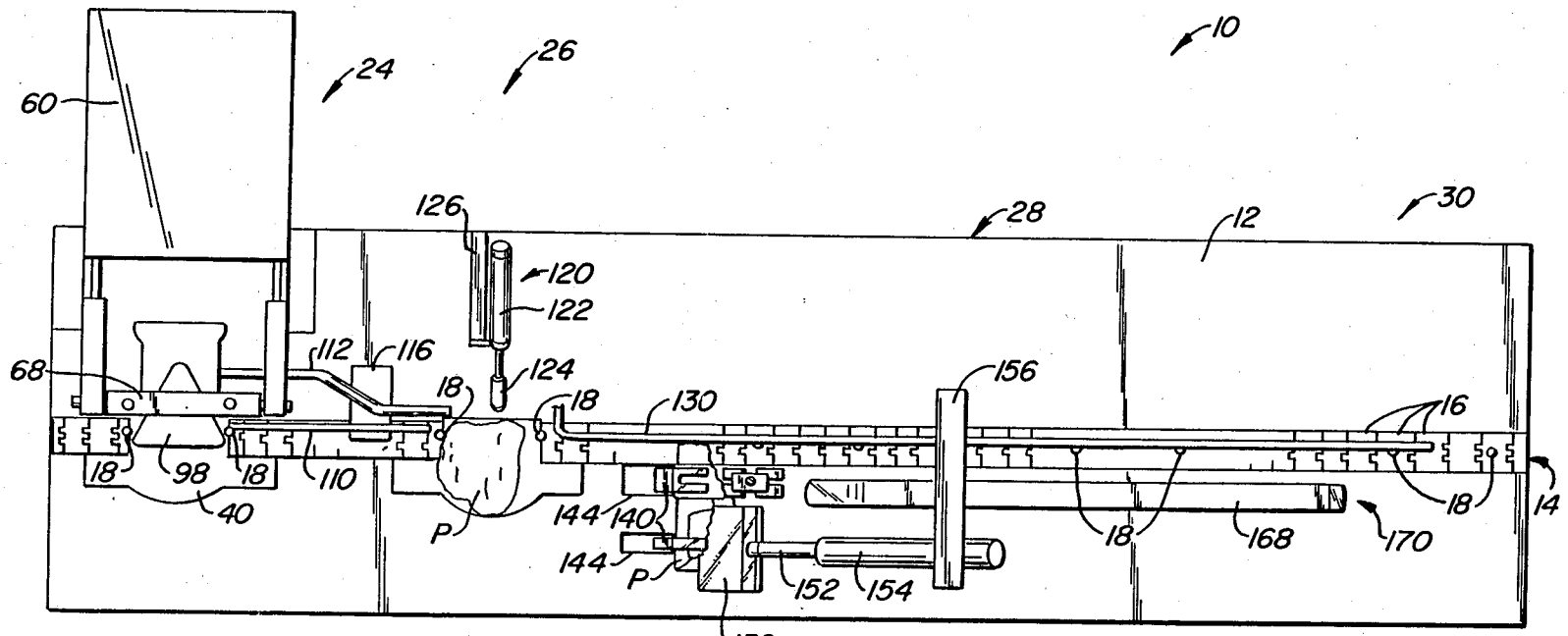
FIG. 1 is a top schematic view of the folding apparatus of the present invention.

Referring to FIG. 1, the folding apparatus 10 of the present invention comprises a floor-mounted work table 12 having an axial conveyor belt 14 mounted thereon. A drive motor (not shown) capable of incrementally advancing the conveyor through a fixed distance is provided. The conveyor 14 is made up from a plurality of hinged plates 16 which form the conveyor belt surface. Certain ones of the hinged plates 16 include vertical retaining pins 18 which are spaced apart by a distance selected to secure the header cards which are to be folded, as described in greater detail hereinbelow.

The folding apparatus 10 includes four work stations as follows. The first work station 24 is the header card magazine and feeding assembly which places individual header cards on the conveyor belt 14. The second work station 26 is the divider flap folding assembly where the vinyl pants are placed on the header card and the divider flap is folded down over the pants. The third work station 28 is the side flap folding and sealing assembly where the side flaps are folded back over the divider flap and sealed with each other in order to complete the packaging operation. The fourth work station 30 is the pressure plate and discharge assembly.

Figure 2:
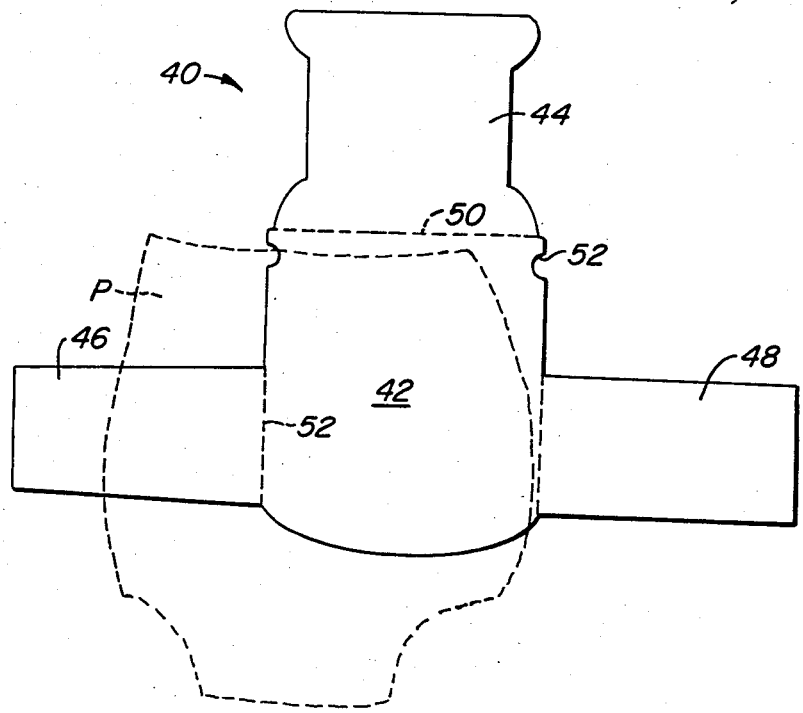
FIG. 2 illustrates the unfolded header card which is folded by the apparatus of FIG. 1.

Referring now to FIG. 2, a header card 40 suitable for use with the apparatus 10 of the present invention is a single-ply cardboard card having a central portion 42 with three flaps 44, 46, and 48 extending orthogonally outward therefrom. The first flap 44 is referred to as the divider flap and is folded directly over onto the vinyl pants P (shown in broken line) along a fold line 50. The second flap 46, referred to as the back flap, is next folded over along fold line 52 so that both the flap 46 and the pants P are folded over the divider flap 44. The third flap 48, referred to as the leading flap, is then folded over onto the back flap, after an adhesive has been applied to the exposed surface of the back flap 46.

Referring now to FIGS. 3A–3D, the header card magazine and feeding assembly 24 includes the header card magazine 60 which holds a plurality of individual unfolded header cards 40 and a header card placement assembly 62.

The header card placement assembly 62 includes a pair of upright posts 64 each having a cantilevered beam 66 projecting outward from the top thereof. A journaled support bar 68 (See FIG. 3D) extends between the distal end of each of the beams 66 and is free to rotate about a horizontal axis. Reciprocating rods 70 are received in spaced-apart slide bearings mounted in the journaled support member 68. The rods 70 slide freely within the bearings and terminate at blocks 74 at the opposite end.

A second cantilevered beam 80 extends from each vertical post 64, and an axle 82 extends therebetween. Rotating arms 84 are fixedly mounted on the axle 82, as is lever arm 86. Torque on the lever arm 86 causes the axel 82 to rotate, which in turn causes the arms 84 to rotate.

A support rod 88 extends between the distal ends of rotatably arms 84 and is mounted in bearings 90. Terminal blocks 74 are fixedly secured to the support rod 88 so that the terminal blocks are advanced through an arc 92 (FIG. 3A) as the rotatable arms 84 are rotated.

Figure 3A:
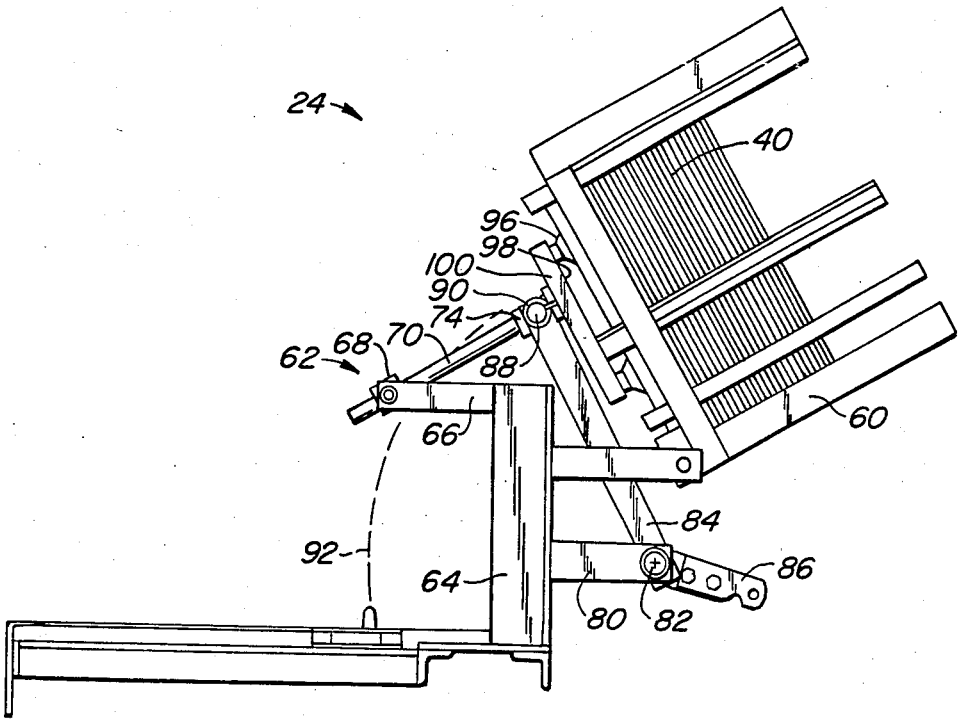
FIGS. 3A–3D illustrate the header card magazine and feeding assembly located at the first work station of the folding apparatus of the present invention.
Figure 3B:
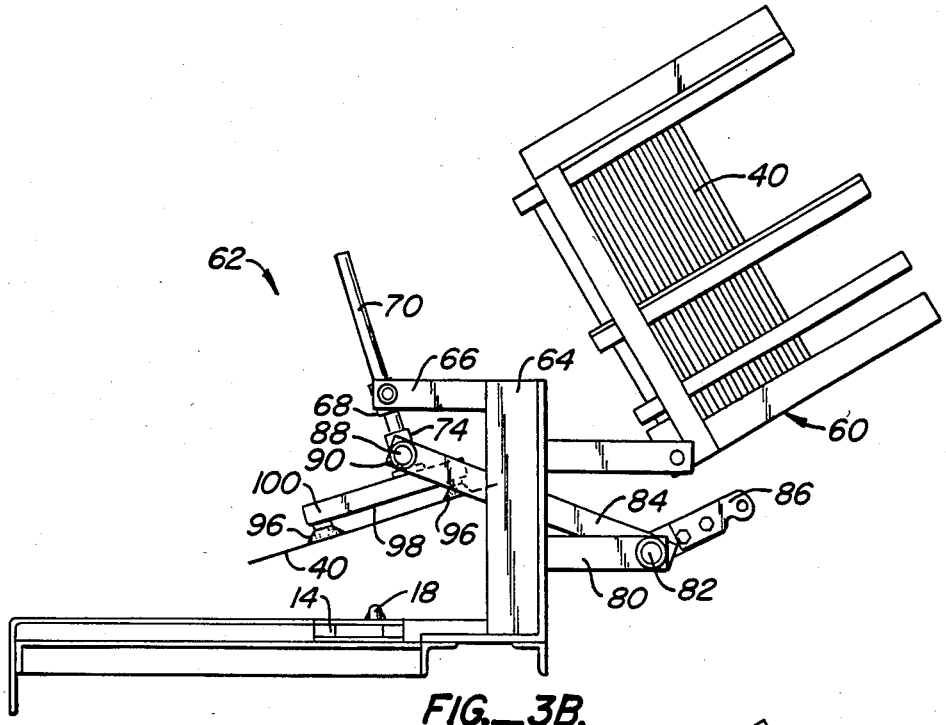
Figure 3C:
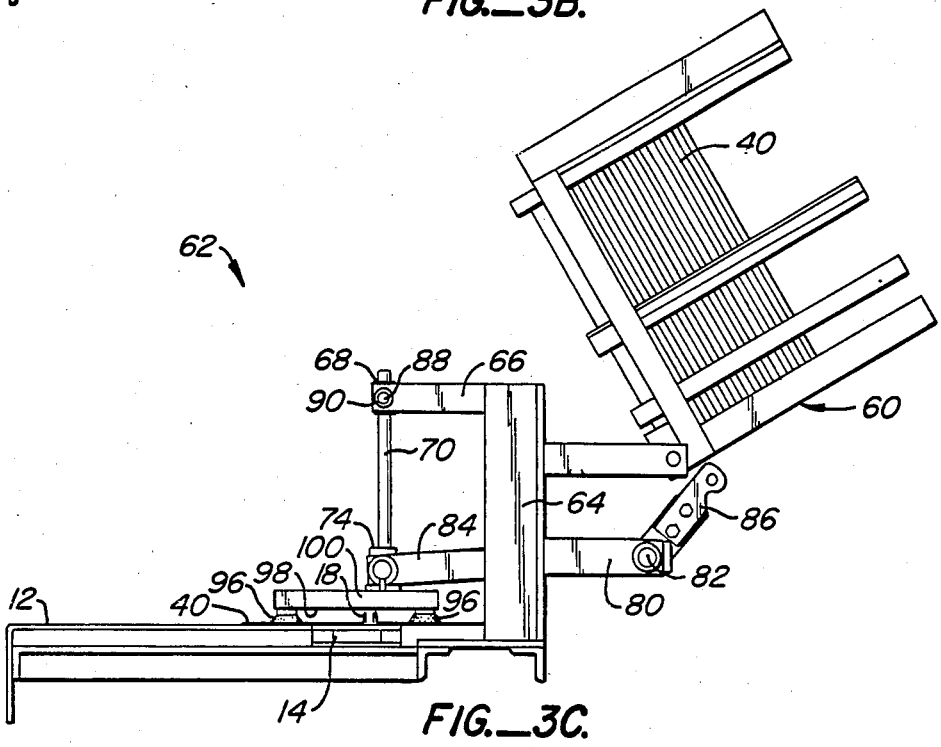
Figure 3D:
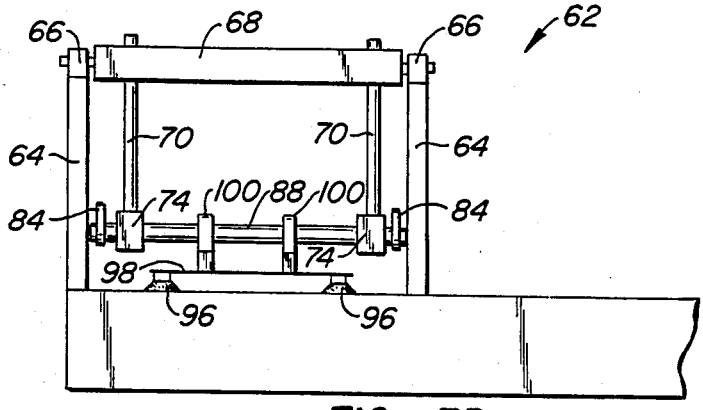

Suction cups 96 are mounted on a plate 98 which is secured to the support rod 88 on blocks 100. The blocks 100 are fixed to the support rod 88 so that the plate 98 rotates in unison with the support rod. Rotation of the support rod 88, in turn, is determined by the orientation of the terminal blocks 74 on sliding rods 70. Thus, the plate 98 will always be oriented perpendicularly to the support rods 70, as illustrated in FIGS. 3A–3C. The sliding rod 70, however, will rotate through an arc of greater than 90° as it travels from picking up the header cards 40 in magazine 60 through placing the header cards down on the conveyor 14.

Referring in particular to FIG. 3A, suction cups 96 are initially disposed against the lowermost header card 40 in magazine 60. After applying a suction to firmly secure the individual header card 40, lever arm 86 is rotated by a linkage (not shown) in the counterclockwise direction. This causes rotatable arm 84 to rotate in the counterclockwise direction, which in turn causes the sliding arms 70 to rotate in the clockwise direction about the axis defined by support beam 68. As the rods 70 are rotated, they will slide through bearing members 72. Lever arm 86 is further rotated until the header card feeding assembly reaches the configuration illustrated in FIG. 3B. The rotatable arm has traveled through approximately 45°, while the sliding rods 70 have traveled through a somewhat greater angle. The header card 40 carried by the suction cups 96 on plate 98 is approaching the conveyor 14. Rotation of the lever arm 86 is completed, as illustrated in FIG. 3C, when the header card 40 is placed flat down against the conveyor surface so that detents 52 (FIG. 2) are received on retaining pins 18 on the conveyor 14. At this point, suction in suction cups 96 is terminated and the placement assembly 62 raised to secure the next header card. The header card 40 on the conveying surface is ready to be conveyed to the next work station 26.

Figure 4:
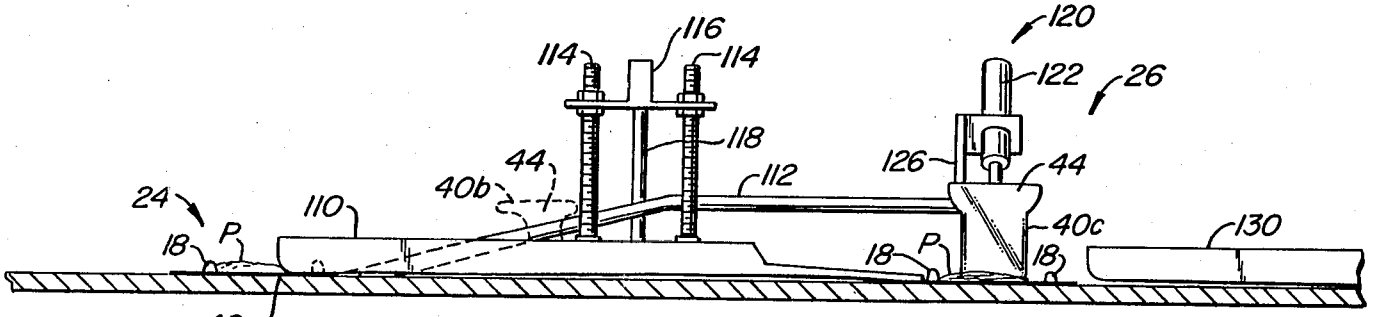
FIG. 4 illustrates the divider flap folding assembly which is located at the second work station of the present invention.
Figure 5A:
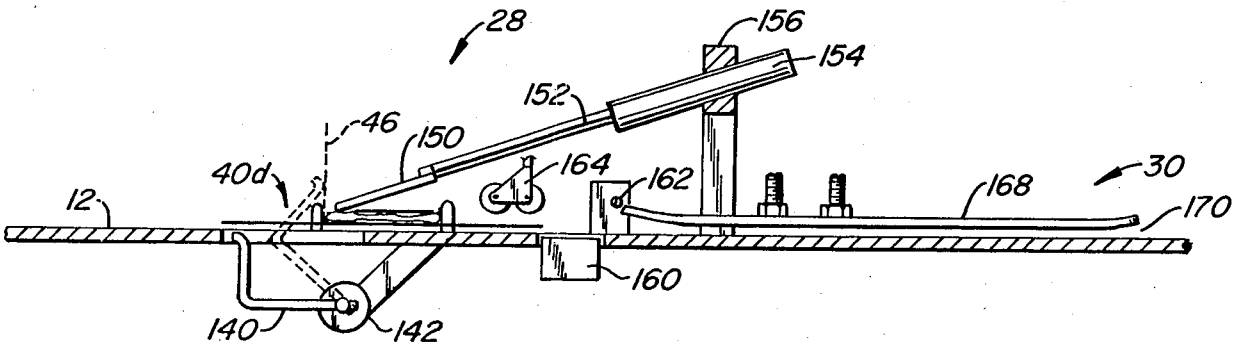

Referring now to FIGS. 1 and 4, the mechanism for folding the divider flap 44 over onto the central portion 42 of the header card 40 will be described. After being positioned at station 24 by the feeder assembly, as just described, the header card **40*a* is advanced on the conveyor 14 beneath a retaining blade 110. The retaining blade 110 is aligned so that it lies directly over fold line 50 (FIG. 2) on the header card 40. An inclined bar 112 is secured to the support table 12 so that it lies beneath the divider flap 44 as the header card 40*b* is advanced from station 24 to station 26. Initially, at the end adjacent work station 24, the inclined bar 112 is flush with the table top and located so that it lies beneath the distal end of the divider flap 44. From there, the bar 112 rises and moves inward until it is substantially adjacent the conveyor 14. Thus, as the header card 40*b* travels from station 24 to station 26, the divider flap is folded upward and inward by the incline bar 112. The folding occurs along line 50, as clearly defined by the retaining blade 110. The retaining blade 110 is supported on vertical rods 114 attached to a cantilever plate 116 which in turn is mounted on a post 118 which is directly secured to the table 12**.

Once the header card **40*c* reaches work station 26, the divider flap 44 is folded up at an approximately right angle. The retaining blade 110 terminates, as does the inclined bar 112. At this point, the vinyl pants P are manually placed on the header card 40*c* substantially in the position illustrated in FIG. 2. The divider flap 44 is then closed by a plunger assembly 120 mounted behind (as viewed in FIG. 4) the divider flap 44 when it is located at work station 26. The plunger assembly 120 includes an air cylinder 122 and rod 124 which are mounted on a vertical post 126 attached to the table 12. As the rod 124 is extended, it pushes down to close the divider flap 44 over the pants P on the header card 40*c*. As the folded header card 40 leaves work station 26, the end of the card near the fold line 50 is received beneath a rail 130. The rail 130** holds the divider flap down throughout the remainder of the folding operation.

Referring now to FIGS. 1 and 5A–5C, the folding of the side flaps at the third work station 28 will be described. The third work station 28 includes folding arms 140 which are located beneath table 12 and rotatably mounted on a motor 142. The motor 142, in turn, is directly attached to the bottom of table 12. The folding arms 140 are L-shaped and rise upward through a pair of slots 144 formed in the table 12.

A folding plate 150 is mounted at the terminal end of a rod 152 mounted in air cylinder 154. The air cylinder 154, in turn, is mounted on a bracket 156 extending over the conveyor 14, so that the folding plate 150 is capable of extending down to a position adjacent fold line 52 (FIG. 2) on header card **40*d* when the header card is in place at work station 28**.

Figure 5B:
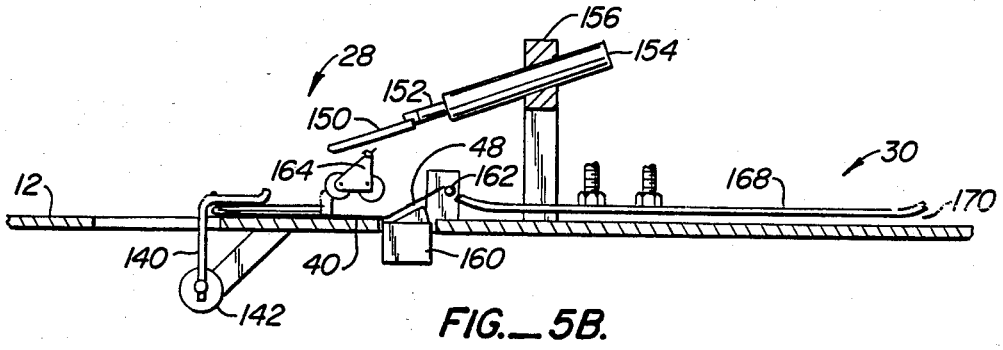
FIGS. 5A–5C illustrate the side flap folding and sealing mechanism which is located at the third work station of the present invention.
Figure 5C:
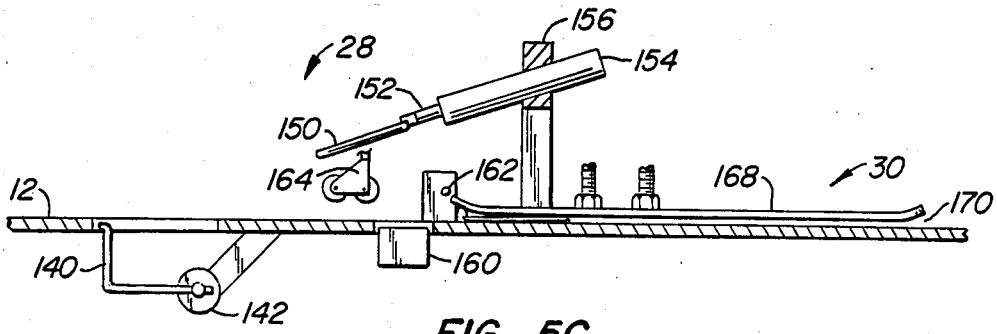

The back flap 46 of the header card is folded by first extending down the folding plate 150 and thereafter actuating the folding arms 140 in the clockwise direction. The side flap 140 is folded upwards (as illustrated in broken line in FIG. 5A) approximately 90°, and then the folding plate 150 is retracted. The fold is completed as illustrated in FIG. 5B. At this point, both the back flap 46 and the vinyl pants P have been folded over the divider flap 42.

As the partially folded header card 40 is advanced from the position as shown in FIG. 5B, two events happen substantially simultaneously. First, a reciprocatable ramp 160 is extended upward to raise the leading flap 48 upward. The leading flap 48 is then caught by a transverse stationary bar 162 so that the fold is completed as the header card 40 moves forward. At about the same time, an adhesive is applied by adhesive applicator 164 onto the exposed surface of the folded back flap 46. Thus, when the fold of the leading flap 48 is completed, it will adhere to the back flap 46 to complete the package.

From the side flap folding station 28, the folded package travels to the pressure plate station 30 which holds the package together as it travels beneath pressure plate 168 until the glue has a chance to set. When the package is discharged from discharge end 170, it is ready for packaging in larger containers and shipment.

Although the foregoing invention has been described in some detail by way of illustration and example for purposes of clarity of understanding, it will be obvious that certain changes and modifications may be practiced within the scope of the appended claims.

What is claimed is:

1. A method for packaging fabric articles on header cards having a central portion and three flaps extending outward from the central portion, said method comprising:

incrementally advancing the header cards a fixed distance along a path;

placing one fabric article on each header card at a first location along the path, said article being placed to cover at least the central portion and one of the flaps while leaving at least one flap uncovered;

folding an uncovered first flap over onto the article at a second location which is an integral multiple of said fixed distance from the first location along the path;

folding a covered second flap over onto the first flap at a third location which is an integral multiple of said fixed distance from the first location along the path so that a portion of the article is folded onto the first flap together with the second flap;

applying an adhesive onto the surface of the second flap at a fourth location which is an integral multiple of said fixed distance from the first location along the path; and folding the third flap over onto the second flap at a fifth location which is an integral multiple of said fixed distance from the first location along the path so that the third flap adheres to the second flap.

2. A method as in claim 1, wherein the first and second locations along the path are the same.

3. A method as in claim 1, wherein the third and fourth locations along the path are the same.

4. A method as in claim 1, wherein the fabric articles are manually placed on the header card at the first location.

5. A method as in claim 1, wherein the header cards are advanced on a linear conveyor.

6. A method for folding fabric articles onto header cards having a central portion, a divider flap extending axially from the central portion, and a leading flap and a back flap extending transversely from the central portion, said method comprising:

placing the header card on a conveyor belt with the divider flap extending to one side of the belt;

advancing the belt so that the divider flap is raised by an inclined bar immediately adjacent the belt;

placing one fabric article on the header card so that said article covers the central portion of the card and at least a portion of the back flap;

folding the divider flap completely over onto the fabric article on the card;

advancing the belt until the card lies over a rotatable clamp member;

rotating the clamp member to fold the back flap of the card over onto the divider flap so that the fabric article is folded over the divider flap;

applying an adhesive to the folded back flap; and folding the leading flap over onto the back flap by raising the leading flap and advancing the conveyor so that the leading flap is caught by a fixed bar above the conveyor, whereby the leading flap is folded over onto the back flap and secured thereto by the adhesive.

7. A method as in claim 6, wherein the header card is removed from a magazine and placed on the conveyor belt by suction cups mounted on a rotating arm.

8. A method as in claim 6, wherein the fabric article is manually placed on the header card.

9. A method as in claim 6, wherein the divider flap is folded onto the fabric article by a reciprocating plunger.

10. A method as in claim 10, wherein the leading flap is held down against the back flap as the conveyor is advanced underneath a pressure plate.

11. A system for folding flat header cards having fabric articles placed thereon, said header cards including a central portion and three orthogonal flaps extending outward from the central portion, the fabric articles being placed on the central portion and one of the flaps, said system comprising:

means for advancing the header card along a path;

means located along a segment of the path for clamping the header card along a line between a first flap and the central portion while the header card is being advanced;

an inclined ramp along the segment for elevating the first flap as the article is advanced along the path;

means for folding the first flap over onto the central portion of the header card and the fabric article located along the path beyond the clamping means;

means located along the path for clamping the fabric article and the header card along a second line between a second flap and the central portion;

reciprocatable folding forks for folding over the second flap having the fabric article thereon while the second clamping means is disposed against the fabric article and the header card;

a reciprocatable ramp located along the path so that the third flap will be raised when the ramp is elevated and along the header card advanced along the path and over the ramp; and a folding bar fixed transversely over the path so that the third is engaged and folded over the second flap as the header card is advanced along the path.

12. A system as in claim 11, wherein the means for folding the first flap over onto the central portion is a reciprocatable plunger.

13. A system as in claim 11, wherein the means for clamping the article along a second line comprises a reciprocatable plate which is mounted above the advancing means.

14. A system as in claim 11, wherein the reciprocatable forks are mounted beneath the advancing means and extend therethrough.

15. A system as in claim 11, wherein the advancing means comprises a table having a conveyor belt mounted thereon.

16. A system as in claim 11, further comprising a pressure plate located along the path after the folding bar, which pressure plate holds the third flap against the second flap to allow an adhesive to set.

17. A system for folding fabric articles onto header cards, where said header cards include a central portion, a dividing flap, a leading flap, and a back flap, the fabric article being placed on the central portion and the back flap of the header card, said system comprising:

a table;

a conveyor belt mounted on said table;

means for incrementally advancing the conveyor belt through a fixed distance unit;

a magazine for holding a plurality of flat header cards;

means for singly taking header cards from the magazine and placing them at one end of the conveyor with the divider flap transverse to the conveyor and the leading and back flaps aligned with the conveyor;

an inclined bar parallel to the conveyor for raising the divider flap as the header card is advanced;

a plunger assembly located near the end of the inclined bar to fold over the divider flap onto the fabric article and the central portion after it has been raised;

rotating clamp members located at an integral number of fixed distance units down the conveyor from the plunger assembly, said clamp members being capable of folding the back flap and the fabric article over the dividing flap;

means for applying an adhesive to the back flap after it has been folded;

a reciprocatable inclined ramp for raising the leading flap as the header card is advanced from the rotating clamp members; and a fixed bar mounted transversely to the conveyor for folding the leading flap back over onto the back flap so that the leading flap and the back flap will be secured by the adhesive.

* * * * *